US010844565B2

(12) United States Patent
Arslan et al.

(10) Patent No.: US 10,844,565 B2
(45) Date of Patent: Nov. 24, 2020

(54) SYSTEMS AND METHODS FOR REDUCING SCOURING

(71) Applicants: Haydar Arslan, Spring, TX (US); Patrick C. Wong, Cypress, TX (US)

(72) Inventors: Haydar Arslan, Spring, TX (US); Patrick C. Wong, Cypress, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/591,669

(22) Filed: Jan. 7, 2015

(65) Prior Publication Data

US 2015/0218770 A1 Aug. 6, 2015

Related U.S. Application Data

(60) Provisional application No. 61/936,758, filed on Feb. 6, 2014.

(51) Int. Cl.

| | |
|---|---|
| ***E02D 5/22*** | (2006.01) |
| ***E02D 13/04*** | (2006.01) |
| ***E02D 27/22*** | (2006.01) |
| ***E02D 23/00*** | (2006.01) |
| ***E02B 17/00*** | (2006.01) |
| ***E02D 5/60*** | (2006.01) |
| ***E02D 27/42*** | (2006.01) |

(52) U.S. Cl.

CPC ..... *E02B 17/0026* (2013.01); *E02B 17/0017* (2013.01); *E02B 17/0034* (2013.01); *E02D 5/60* (2013.01); *E02D 27/42* (2013.01); *E02D 27/425* (2013.01)

(58) Field of Classification Search

CPC ..... F05B 2240/95; E02D 5/22; E02D 13/04; E02D 27/22; E02D 27/32; E02D 27/50; E02D 23/00; E02D 23/08; E02D 5/60

USPC ..... 405/211, 211.1, 223.1, 224, 231, 249

See application file for complete search history.

(56) References Cited

U.S. PATENT DOCUMENTS 3,859,803 A * 1/1975 Pedersen ..... E02B 3/24 405/211
4,220,421 A * 9/1980 Thorne ..... E02D 27/52 405/211
4,552,486 A * 11/1985 Knox ..... E02B 17/0008 405/225

(Continued)

FOREIGN PATENT DOCUMENTS

JP 2004-339695 12/2004
KR 02-74072 5/2002

(Continued)

*Primary Examiner* — Edwin J Toledo-Duran
(74) *Attorney, Agent, or Firm* — ExxonMobil Upstream Research Company—Law Organization

(57) ABSTRACT

Systems and methods for reducing scouring around piles are described. The system includes a pile and an enclosure. The pile has a maximum cross-sectional dimension, $D_p$. The enclosure is circumferentially disposed around the pile, the enclosure having a first end proximate a surface of a seabed; a second end distal the surface of the seabed; and a maximum cross-sectional dimension, $D_e$, wherein $D_e$ is at least $1.25*D_p$.

20 Claims, 5 Drawing Sheets

(56) References Cited

U.S. PATENT DOCUMENTS

| | | | | |
|---|---|---|---|---|
| 4,717,286 | A * | 1/1988 | Loer | E02B 3/12 405/74 |
| 6,012,874 | A * | 1/2000 | Groneck | E02D 5/38 405/239 |
| 8,465,229 | B2 | 6/2013 | Maconocie et al. | |
| 8,596,919 | B2 * | 12/2013 | Harris | E02D 5/60 405/211 |
| 2009/0129870 | A1 * | 5/2009 | Jones | E02D 7/16 405/228 |
| 2009/0297276 | A1 * | 12/2009 | Foo | B63B 21/27 405/224 |
| 2010/0119309 | A1 * | 5/2010 | Gibberd | E02D 7/28 405/228 |
| 2011/0002742 | A1 * | 1/2011 | Maconocie | E21B 7/20 405/227 |
| 2011/0188945 | A1 * | 8/2011 | Hartkopf | F03D 13/10 405/224 |
| 2012/0003048 | A1 * | 1/2012 | Hosoy | E21B 33/043 405/172 |
| 2012/0128436 | A1 * | 5/2012 | Harris | E02D 27/52 405/302.6 |
| 2013/0011203 | A1 * | 1/2013 | Reinhall | E02D 5/24 405/228 |

FOREIGN PATENT DOCUMENTS

| | | | |
|---|---|---|---|
| WO | 2013/022338 | A1 | 2/2013 |
| WO | WO 2013022338 | A1 * | 2/2013 |

* cited by examiner

500

SYSTEMS AND METHODS FOR REDUCING SCOURING

CROSS-REFERENCE TO RELATED APPLICATION

This application claims the benefit of U.S. Provisional Application No. 61/936,758, filed Feb. 6, 2014, the entirety of which is incorporated by reference herein.

FIELD

The present disclosure relates generally to a modified pile foundation system for scour protection. In particular, the present disclosure relates to systems and methods for reducing scouring by disposing an enclosure around a pile.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Pile foundations may be utilized for the support of various structures such as offshore structures, including large offshore platforms, floating storage vessels, oil-rigs, and other offshore subsea equipment to safely carry and transfer a structural load to the bearing strata located at some depth below the surface of the sediment. In operation, a pile foundation may steady and hold the position of the offshore structure in a harsh environment including rough currents, waves, flood-waters, and any action caused by a vessel-propeller. Today, pile foundation systems are one of the most commonly used anchoring technologies in transferring load through compressible or component sediments in many deep-water offshore production techniques.

There are various types of piles and many are classified with respect to their load transmission and functional behavior. Types of piles include end bearing piles, settlement reducing piles, tension piles, laterally loaded piles, piles in fill, and friction piles. Friction piles derive their load carrying capacity from the adhesion or friction of the soil sediment in contact with the shaft of the pile. The load carrying capacity of a friction pile may be partially derived from end bearing and partially from skin friction between the embedded surface of the pile and the surrounding soil.

One type of friction pile is a suction pile and is an alternative to traditional pile foundations such as driven piles, drag anchors, and gravity caissons. The advantages of suction piles, as opposed to traditional systems, may include various cost cutting benefits and ease of installation and removal. A suction pile may be a cylindrical structure, closed on one end and open on the other, and may be used underwater to secure many offshore structures.

There are usually two stages to the installation of the suction pile. The first stage may include lowering the suction pile onto the seabed where the suction pile is partially embedded deep into the soil sediment under its own weight. The second stage may include the suction pile undertaking a suction force created by pumping water out of the top of the suction pile through a port. The proportions of the pile and the suction force may be dependent upon the type of soil sediment the suction pile may encounter. Sand may be difficult to penetrate but may provide good holding capacity. Thus, the height of the suction pile may be as short as half the diameter and the hydraulic gradient may reduce the resistance of the sand to zero. With clays and mud soil types, the suction pile may easily penetrate but such sediment types may provide poor holding capacity. Thus, a suction pile in a clay or mud environment may have a height that is several times greater than its diameter. Additionally, in a clay and mud environment, the suction force may exceed the tip and skin resistance of the pile. Thus, site investigative soil test may be conducted to determine the impact of the sediment's capacity on the pile.

Another type of frictional pile is a driven pile which may be a structural column configured to be driven, pushed, or otherwise installed into the soil. Driven piles may be installed using some form of external weighted force such as a hammer to drive the pile into unexcavated soil.

One conventional method of driving a pile into place may include using a heavy weight placed between guides and raising the weight until it reaches its highest point. The weight may then be released landing forcefully upon the pile in order to drive the pile deep into the sediment. Various methods may be utilized to raise the weight and drive the pile including a diesel hammer, a hydraulic hammer, a hydraulic press-in, a vibratory pile driver, a vertical travel lead system, among other methods.

Regardless of the type of pile utilized, the removal and deposition of seabed sediment caused by waves and currents may significantly reduce the holding capacity of the pile. This removal of the seabed sediment is referred to as scouring. Scouring may occur when waves and currents pass around an object, such as a pile in the water column. Several types of scouring may be identified with piles supporting offshore structures. One type of scouring may include erosion of the sea bottom (sea-bottom scour) proximate the pile due to unidirectional waves and currents. As the water flows around the pile or the pile is struck by forceful waves and currents, the water may change direction and accelerate. Another type of scouring may include the loss of soil around a pile due to the cyclic deflection of the pile under wave forces or the movement of mooring lines attached to the pile. Scouring may also occur due to ice dragging on the seabed. Thus, the sediment located in close proximity to the pile may be loosened, suspended, and carried away by such actions. This may possibly affect the functional basis of the pile located in the sediment and thus the stability of the offshore structure moored to the pile.

U.S. Pat. No. 8,465,229 to Maconocie et al. discloses an improved system for increasing an anchoring force on a pile. A sleeve is installed over the pile and may be used to provide an additional connecting force to the existing pile. The sleeve may include its own padeye for coupling an anchor line or other coupling member to a structure to be secured. Additionally, the sleeve may include an assembly of rings coupled together with at least one or more longitudinal members.

U.S. Patent Publication No. 2012/0128436 by Harris discloses a disk around a pile in an effort to reduce scouring in close proximity to the pile. The disk has a pile opening through which the pile protrudes and the disk sits on top of the seabed. The disk may include a peripheral skirt for embedding into the seabed below the portion of the disk installed above the seabed. The disk may also include partitions for segmenting chambers of the disk. The chambers may be filled with fluidized fill material, such as grout or concrete to hold the disk in place. However, there still remains a desire to provide scour protection to a pile system while providing maximum surface area contact between the pile and surrounding soil.

SUMMARY

In one aspect of the present disclosure, a system for reducing scouring is provided. The system includes a pile having a maximum cross-sectional dimension, $D_p$. The system also includes an enclosure that is circumferentially disposed around the pile, the enclosure having a first end proximate a surface of a seabed; a second end distal the surface of the seabed; and a maximum cross-sectional dimension, $D_e$, wherein $D_e$ is at least 1.25 times $D_p$.

In another aspect of the present disclosure, a method for reducing scouring around a pile is provided. The method providing a pile, where the pile has a maximum cross-sectional dimension, $D_p$. The method also includes installing an enclosure circumferentially around the pile, where the enclosure has a first end proximate a surface of a seabed, a second end distal the surface of the seabed, and a maximum cross-sectional dimension, $D_e$, wherein $D_e$ is at least 1.25 times $D_p$.

In yet another aspect of the present disclosure, a system for reducing scouring around anchors used for offshore production facilities is provided. The system includes a plurality of piles for stabilizing an offshore floating structure, where each pile has a maximum cross-sectional dimension, $D_p$. The system also includes an enclosure that is circumferentially disposed around each pile, the enclosure having a first end proximate a surface of a seabed; a second end distal the surface of the seabed; and a maximum cross-sectional dimension, $D_e$, wherein $D_e$ is at least 1.25 times $D_p$.

DESCRIPTION OF THE DRAWINGS

The advantages of the present disclosure are better understood by referring to the following detailed description and the attached drawings, in which.

DETAILED DESCRIPTION

Figure 1:
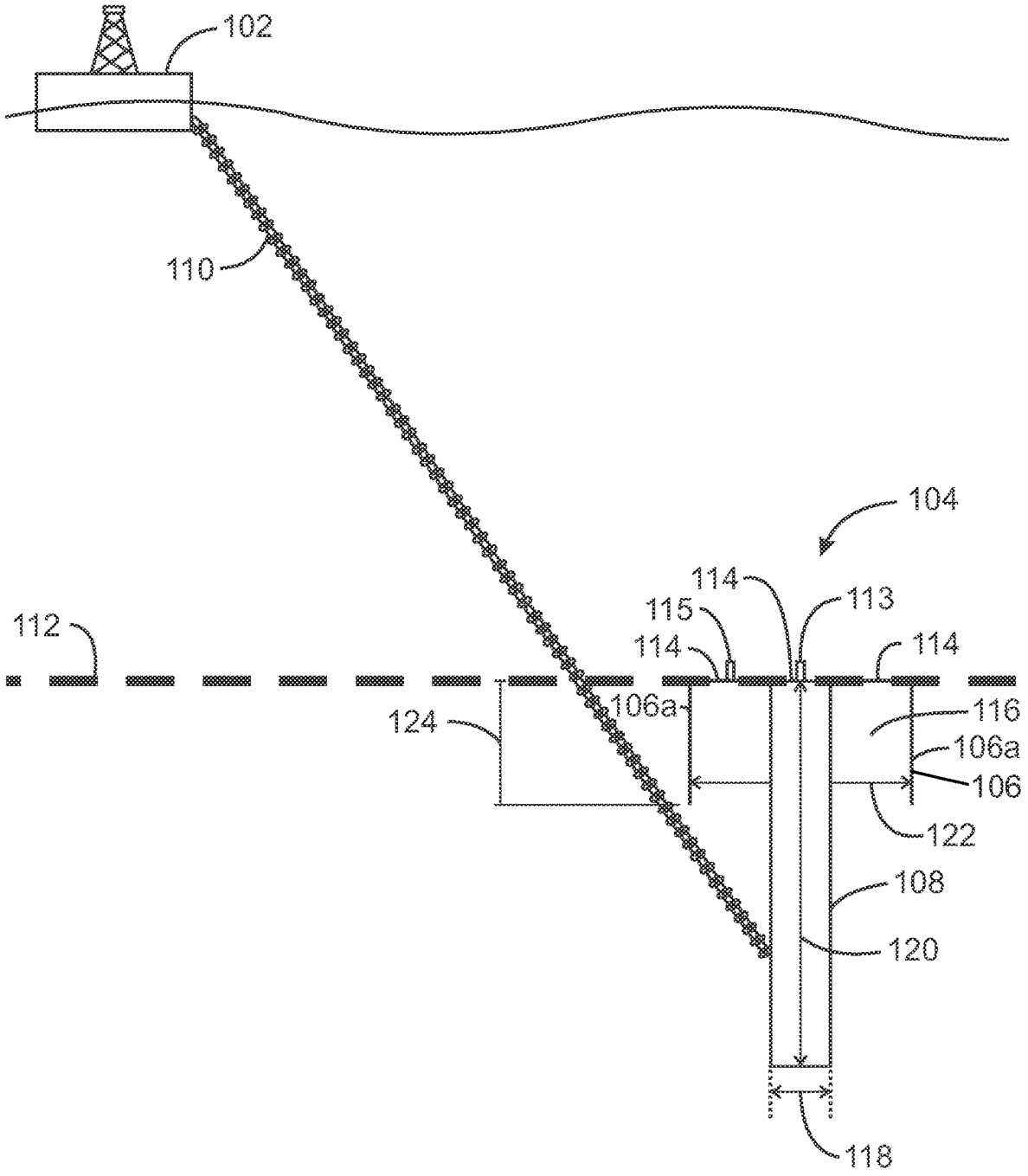
FIG. 1 is an illustration of an offshore floating platform and a pile foundation system that includes an enclosure used to reduce scouring in accordance to one or more embodiments of the present disclosure.

In the following detailed description section, the specific embodiments of the present disclosure are described in connection with one or more embodiments. However, to the extent that the following description is specific to a particular embodiment or a particular use of the present disclosure, this is intended to be for exemplary purposes only and simply provides a description of the one or more embodiments. Accordingly, the disclosure is not limited to the specific embodiments described herein, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

The term, "seabed" or "seafloor" as used herein means soil sediment located under a body of water. The body of water may be a freshwater body or a seawater body.

The term "substantially", "substantially the same" or "substantially equal" as used herein unless indicated otherwise means to include variations of a given parameter or condition that one skilled in the pertinent art would understand is within a small degree variation, for example within acceptable manufacturing tolerances. Values for a given parameter or condition may be considered substantially the same if the values vary by less than 5 percent (%), less than 2.5%, or less than 1%.

The term "substantially different" as used herein means to include variations of a given parameter or condition that one skilled in the pertinent art would understand is not within a small degree of variation, for example outside of acceptable manufacturing tolerances. Values for a given parameter or condition may be considered substantially different if the values vary by greater than 1%, greater than 2.5%, or greater than 5%.

Scouring may cause seabed degradation and erosion around a pile. In some instances, the scouring may be significant, for example reaching a depth of at least twice the diameter of the pile, the maximum diameter of a pile may be 1.25 to 6 meters. Thus, if the soil sediment proximate the pile foundation is disturbed due to scouring activity, this may have severe implications on the functional performance of the pile. For example, the loads the pile may support may be reduced or the pile may become dislodged from the seabed floor, making the pile unstable and susceptible to various movements. In such situations, failure of the pile foundation system and unguided movement of the offshore structure may occur.

Embodiments of the present disclosure provide methods and systems for reducing souring. The system for reducing souring includes a pile. The pile may be a new or existing pile. The pile may be any suitable pile, for example a pile selected from the types of piles as described herein. In one or more embodiments, the pile may be commonly used in the offshore hydrocarbon production industry to moor offshore structures, risers, pipelines, and other subsea structures. In one or more embodiments, the pile may be a friction pile, for example a suction pile or a driven pile. A suction pile may also include a suction port to enable a suction force to be applied during installation to remove water and a positive force to be applied to add water during removal of the suction pile from the seabed. The pile may comprise any suitable material, for example concrete or metal. For offshore applications, the metals may include structural steel or cast-iron.

FIG. 1 is an illustration of an offshore floating platform 102 and a pile foundation system 104 that includes an enclosure 106 circumferentially disposed around a pile 108 to reduce scouring. In one or more embodiments, the enclosure may have substantially solid walls. As shown in FIG. 1, the offshore structure 102 may be moored to the pile 108 using a coupling member 110. The coupling member 110 may be a connected series of links used for fastening or securing objects and pulling or supporting loads, such as an anchor chain. The coupling member 110 may be flexible or inflexible and may be made of a material with strength and durability. The pile 108 may provide a level of stability to the structure 102 since it may be exposed to movement due to wind and water forces. The offshore structure 102 may be a structure physically attached to a seabed floor 112 using legs (not shown), which may be embedded in the seafloor 112, a floating structure, for example the floating structure as that depicted in FIG. 1, or any other offshore structure utilizing a pile foundational system which can experience scouring. As an example, the offshore structure 102 may be a floating platform, a bridge, an oil-rig, a drill rig, a tension-leg platform, or any other type of large structure that may require stability in a body of water.

In operation, the pile 108 may penetrate the seabed 112 so that the top of pile 108 may be substantially flush with the seabed level 112. As used herein, the term "substantially flush" means within 1 meter or less of the surrounding seabed level. The method of installing the pile structure 108 may include removing water from a port 113 that, in turn, pulls the pile, e.g. a hollow cylinder, into the seabed 112. In some embodiments, the pile 108 may be forced into the seabed, for example, by driving the pile 108 into the seabed 112, as described herein. It should be noted that a plurality of piles 108 may be embedded in the seabed 112 so as to facilitate stability of the platform 102.

In one or more embodiments, prior to installation, the enclosure 106 may be circumferentially disposed around the pile 108. In one or more other embodiments, the enclosure 106 may be circumferentially disposed around an existing pile located in the seabed 112 to reduce scouring. In particular, axial wall(s) 106*a* of the enclosure 106 surround the upper portion of the pile 108.

A metal plate 114 may be installed at the top of the enclosure 106 at the axial end of the enclosure proximate the seabed 112. In one or more embodiments, the metal plate 114 may be configured to rigidly connect the pile 108 to the enclosure 106 during installation of a new pile. The metal plate 114 may be installed at the top of the pile 108 to preserve the portion of the seabed located between the enclosure 106 and the upper portion of the pile 108. A port 115 in the metal plate 114 may be used to allow water to exit the enclosure 106 during installation of the pile 108. This modified pile foundation system 104 may be implemented to reduce or substantially eliminate scouring of soil sediment 116 in close proximity to the pile foundation system 104, as shown in FIG. 1, and thus extending the long-term integrity of the pile 108.

The pile may include one or more external surfaces in contact with soil sediment. As shown in FIG. 1, the portion of the pile disposed within the enclosure 106 may have a maximum cross-sectional dimension, $D_p$, shown as 118. The maximum cross-sectional dimension, $D_p$ 118, may be at least 1.25 to 6 meters in length. The pile also may have a maximum axial dimension, $L_p$, 120. The maximum axial dimensions may be any suitable dimensions sufficient to accommodate the anticipated loads on the pile. In one or more embodiments, at least 80% of the maximum axial dimension, $L_p$ 120, is disposed beneath the surface of the seabed, for example at least 90%, at least 95%, at least 99% or 100%, same basis. The pile may have an axial length to maximum cross-sectional dimension ratio of greater than two, greater than 3.5, greater than 4, or greater than 4.5, for example in the range of from 2 to 10, from 3.5 to 8.5, same basis. For stiff clays, the axial length to maximum cross-sectional dimension ratio of the pile may be in the range of from 3.5 to 4. For intermediate strength clays and other non-clay soils, the axial length to maximum cross-sectional dimension ratio of the pile may be in the range of from 4.5 to 7. For soft clays, the axial length to maximum cross-sectional dimension ratio of the pile may be in the range of from 7 to 8.5.

The pile may have any suitable cross-sectional geometry, for example circular, oval, elliptical, or polygonal such as triangular, square, rectangular, pentagonal, hexagonal, etc. In one or more embodiments, one or more external surfaces of the pile may have one or more surface features to enhance frictional contact with the soil sediment.

As previously stated, the enclosure 106 may be configured to be disposed around the pile 108 having a maximum cross-sectional dimension, $D_p$ 118. The enclosure has a maximum cross-sectional dimension, $D_e$, 122. The maximum cross-sectional dimension, $D_e$, may be at least 1.25 times the maximum cross-sectional dimension, $D_p$ 118, of the associated pile 108 disposed within the enclosure 106. In one or more embodiments, the maximum cross-sectional dimension, $D_e$, may be at least 1.5 times the maximum cross-sectional dimension, $D_p$ 118, of the associated pile, for example at least 1.75 times, at least 2 times, at least 2.5 times, or at least 3 times or more of the associated pile. The radially internal surface of the axial side wall(s) 106*a* of the enclosure 106 may be disposed a given distance from the radially outer surface(s) of the pile such that sufficient seabed 116 remains in contact with the pile 108. This may aid in maintaining the load carrying capacity of the pile 108, i.e. maintaining the effective length of the pile 108, while preventing scouring proximate to the pile 108.

Additionally, the enclosure may have a maximum axial dimension, $L_e$ 124. The maximum axial dimension, $L_e$ 124, may be any suitable dimension sufficient to extend below the surface of the seabed 112 to reduce or prevent scouring proximate the pile 108. In one or more embodiments, the maximum axial dimension, $L_e$ 124, may be determined based on the predicted scour depth for the pile 108. In one or more embodiments, the maximum axial dimension, $L_e$ 124, may be at least 10% of the maximum axial dimension, $L_p$ 120, of the associated pile 108, for example at least 25%, at least 30%, or at least 40%, same basis. In one or more embodiments, at least 80% of the maximum axial dimension, $L_e$ 124, is disposed beneath the surface of the seabed 112, for example at least 90%, at least 95%, at least 99% or 100%, same basis. In one or more embodiments, the enclosure 106 may be configured to axially extend to a depth beneath the surface of the seabed 112 of greater than 1.3 times $D_p$, at least 1.5 times $D_p$, at least 2 times $D_p$, or more.

The enclosure 106 may have any suitable cross-sectional geometry, for example circular, oval, elliptical, or polygonal such as triangular, square, rectangular, pentagonal, hexagonal, etc. The enclosure 106 may have substantially the same cross-sectional geometry as the associated pile 108 or may have a substantially different cross-sectional geometry. In one or more embodiments, one or more external surfaces of the enclosure may have one or more surface features to enhance frictional contact with the soil sediment. The axial length of the enclosure 106 may comprise any suitable metal, for example structural steel or cast-iron metal.

As previously stated, in one or more embodiments, a metal plate 114 may be disposed on top of the axial side wall(s) 106*a* at the axial end of the enclosure 106 proximate the seabed 112. The metal plate 114 may be configured to connect the enclosure 106 and the pile 108. In one or more embodiments, the metal plate 114 may provide a rigid connection facilitated by welding, bolting, clamping, or any other type of connection that provides a sturdy and rigid connection. The metal of the metal plate 114 may comprise substantially the same metal as the axial side wall(s) 106*a* of the enclosure 106 or may comprise substantially different metal from the axial side wall(s) 106*a* of the enclosure 106. The metal plate 114 that may be constructed from any number of metals, such as steel or corrosion resistant alloys, among others. In one or more embodiments, the metal plate 114 may have sufficient weight to aid in disposing the enclosure 106 into the seabed 112. In one or more embodiments, the pile foundation system may be configured to connect enclosure 106 and the pile 108 during penetration of a new pile 108. In one or more other embodiments, the enclosure 106 of the pile foundation system may be disposed around an existing pile 108.

Figure 2A:
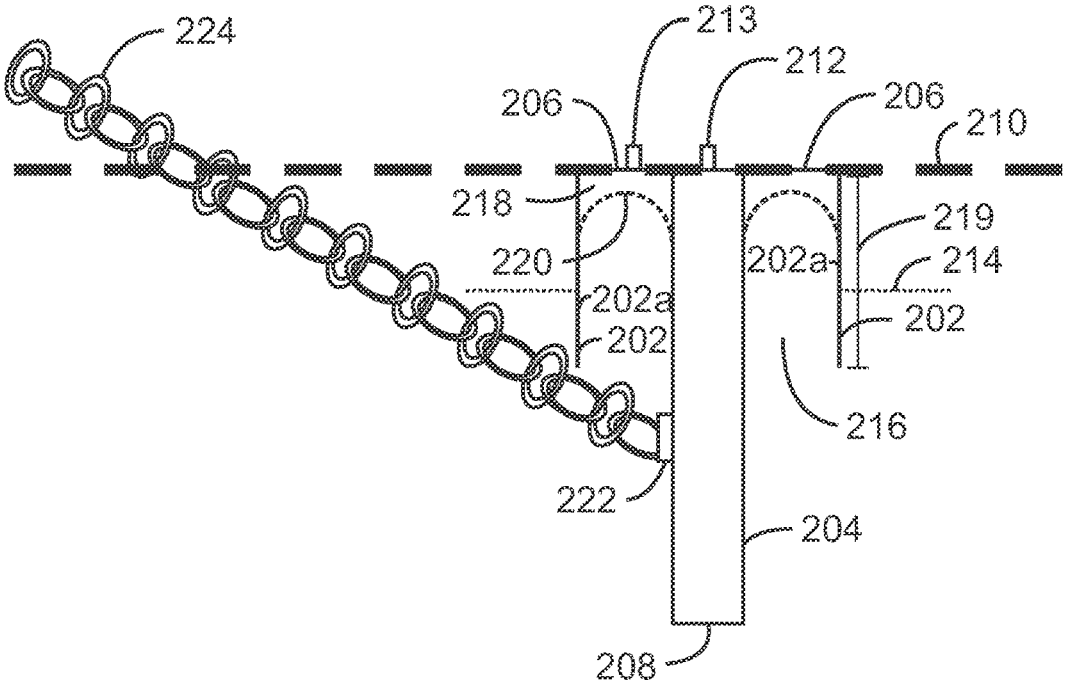
FIG. 2A is an illustration of a side view of an enclosure disposed around a suction pile, the enclosure including a metal plate connecting the enclosure to the suction pile in accordance with one or more embodiments of the present disclosure.

FIG. 2A is an illustration of a side view of an enclosure 202 circumferentially disposed around a suction pile 204, the enclosure 202 including a metal plate 206 connecting the enclosure 202 to the suction pile 204 in accordance with one or more embodiments of the present disclosure. For installation, the open end 208 of the suction pile 204 may be positioned proximate the seabed 210. A lowering mechanism used to position the suction pile 204 on the seabed 210 may be released and withdrawn. The suction pile 204 may initially penetrate into the seabed 210 level by self-weight. The water contained within the cylinder of the suction pile 204 above the seabed 210 may be pumped out through a port 212. This may create a suction force that may force the additional length of the suction pile 204 to embed itself into the seabed 210, e.g., so that the top of the suction pile 204 is substantially flush with the seabed 210, as illustrated in FIG. 2A. Additionally, a port 213 may be located in the metal plate 206 to allow water to exit the enclosure 202 during installation of the suction pile 204. The suction pile 204 may be used in any suitable deepwater application, for example temporary and permanent mooring, including floating production, storage and offloading (FPSO) facilities, offloading buoys, tension leg platform (TLP) foundation, well head supports, among other offshore applications and anchoring pipelines and subsea structures against movement.

The water that may be removed from the suction pile 204 may be pumped out from the port 212 located at the top of the suction pile 204. The removal of the water through the port 212 creates a vertical load on the suction pile 204, forcing it to penetrate deep into the seabed 210. Although the suction pile 204 may initially be substantially flush with the seabed 210, the level of the seabed may be eroded and washed away until a scouring line 214 exists. Without the enclosure 202, the formation of the scouring line 214 and thus, the foundational displacement of the suction pile 204, may lead to the potential exposure and reduction in load carrying capacity of the suction pile 204. Accordingly, the enclosure 202 can reduce or eliminate the scouring proximate the suction pile 204. Additionally, the enclosure 202 can act to potentially increase the long-term integrity of the suction pile 204 by preventing coupling members, ice, waves, and currents from unsettling and removing soil sediment in area 216 located proximate the suction pile 204. This can protect both the sediment area 216 and the suction pile 204 from the adverse effects of scouring. Thus, although scouring may continue to erode other areas of the seabed 210 to scouring line 214, the sediment area 216 immediately adjacent to the suction pile 204 may not be compromised.

The suction pile system, as shown in FIG. 2A, may include rigidly connecting the suction pile 204 to the enclosure 202 using the metal plate 206. Accordingly, the metal plate 206 may be configured to provide a rigid connection between the enclosure 202 and the suction pile 204, as discussed herein. During penetration of the suction pile 204, the enclosure 202 may be connected to the suction pile 204 using the metal plate 206. In one or more other embodiments, the enclosure 202 may be connected to an existing suction pile 204 already penetrated into the seabed 210. The metal plate 206 may also aid in maintaining an even surface in an area 218 between axial wall(s) 202*a* of the enclosure 202 and the suction pile 204 to prevent additional scouring.

The maximum axial dimension, $L_e$ 219, or depth of the enclosure 202 may extend beyond the actual and/or predicted scouring line 214. Thus, the forces that lead to scouring are not able to have an effect upon the sediment area 216 (mitigating scouring) that may be located proximate to the suction pile 204, for example proximate the top portion of the suction pile 204. Accordingly, when the sediment area 216 located near the suction pile 204 is stabilized, the foundation integrity of the suction pile 204 may be ensured. Additionally, such suction pile foundation systems in accordance with the present disclosure may provide for maximum frictional contact (skin contact) between the soil sediment 216 and the outer surface of the suction pile 204 while also providing scour protection.

In one or more embodiments, the metal plate 206 may provide a rigid connection facilitated by welding, bolting, clamping, or any other type of connection that provides a sturdy and rigid connection. The rigid connection may act to securely connect the metal plate 206 to both the suction pile 204 and the enclosure 202. In one or more embodiments, the enclosure 202 may include internal structures 220 to provide strength and stiffness to the enclosure 202. The internal structures may be any suitable structure to provide strength and stiffness to the enclosure without significantly impacting the load carrying capacity of the pile, for example vertical metal plates, metal vertical fins, or radial struts. In one or more embodiments, the internal structures 220 may allow for at least 90% surface contact between the soil sediment 216 and the outer surface of the pile 204 disposed below the seabed 210, at least 95%, or at least 99%, on the same basis.

As shown in FIG. 2A, a padeye 222 may be attached to an outer side surface of the suction pile 204 and may be used as a connection point for a coupling member 224. In one or more embodiments, the coupling member 224 may be a chain, a cable, an anchor line, or any other type of mechanism to securely connect the offshore structure (not shown) to the suction pile 204. In operation, the coupling member 224 may transfer the load from an offshore structure being moored to the suction pile 204. The coupling member 224 may be located at a position deeper within the seabed to achieve optimal suction pile 204 efficiency.

Figure 2B:
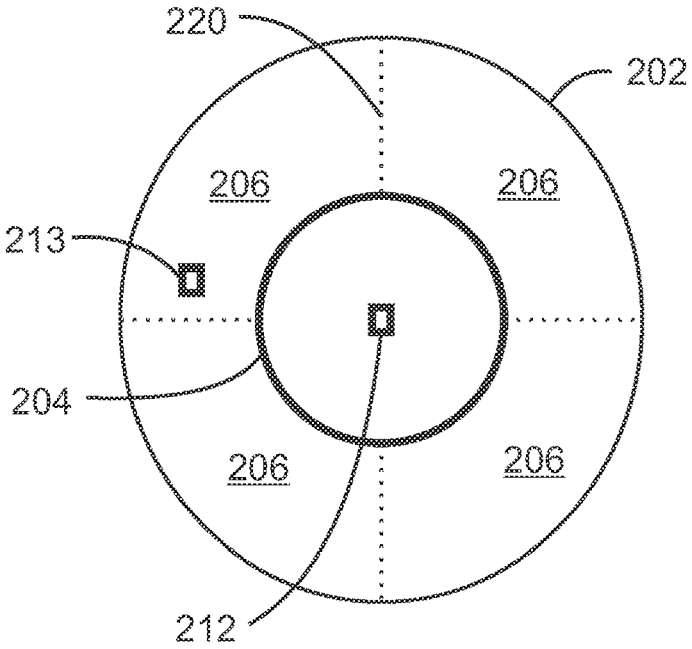
FIG. 2B is an illustration of a top view of an enclosure disposed around a suction pile, the enclosure including a metal plate connecting the enclosure to the suction pile in accordance to one or more embodiments of the present disclosure.

FIG. 2B is an illustration of a top view of an enclosure 202 circumferentially disposed around a suction pile 204, the enclosure 202 including a metal plate 206 connecting the enclosure 202 to the suction pile 204 in accordance to one or more embodiments of the present disclosure. The enclosure 202 may be disposed around the suction pile 204 and connected to the suction pile 204 using the metal plate 206. A port 212 may be located at the top of the suction pile 204 proximate the seabed to facilitate access to the interior volume of the suction pile 204. Water may be pumped out of the suction pile 204 through the port 212 to create a differential pressure in the interior volume to facilitate penetration of the suction pile 204 into the seabed. Additionally, a port 213 may be located in the metal plate 206 to remove water. The internal structures 220, as shown in FIG. 2A, may provide a radial formation between the suction pile 204 and the enclosure 202 to support the enclosure 202.

Figure 3A:
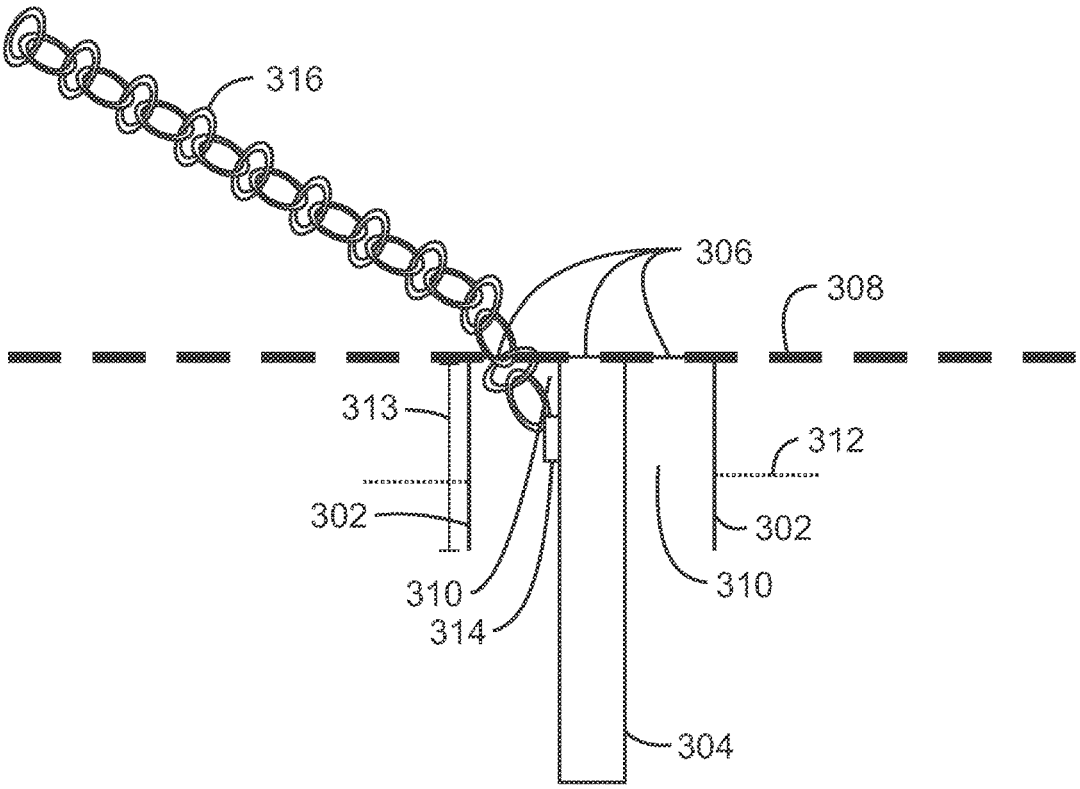
FIG. 3A is an illustration of a side view of an enclosure disposed around a driven pile, the enclosure including a metal plate connecting the enclosure to the driven pile in accordance with one or more embodiments of the present disclosure.

FIG. 3A is an illustration of a side view of an enclosure 302 circumferentially disposed around a driven pile 304 and both the enclosure 302 and driven pile 304 are to be installed together into the seabed. The enclosure 302 includes a metal plate 306 connecting the enclosure 302 to the driven pile 304 in accordance with one or more embodiments of the present disclosure. While a suction pile is often used in deeper waters due to its relative ease of installation and the types of sediment present, a driven pile 304 may be adapted to variable site conditions to achieve uniform load carrying capacity with reliability. The use of a driven pile may be advantageous over a suction pile, whose installation may be more sensitive due to various soil types and layering. Additionally, due to the small size of a driven pile relative to a suction pile, a driven pile may be well suited in water depths where existing driving equipment may be used.

A driven pile 304 may be a column designed to transmit surface loads to low-lying soil or bedrock. Loads may be transmitted by friction between the driven pile 304 and the seabed 308 or by point bearing through the end of the driven pile 304, where the driven pile 304 may transfer the load through a soft soil to an underlying firm stratum. The actual amount of frictional resistance or end bearing may depend on the particular site conditions. In one or more embodiments, the driven pile 304 may be utilized as a foundation system for fixed platforms (jackets), tension-leg platforms (TLP), semisubmersible platforms; floating production, storage and offloading (FPSO) facilities, buoys, among other subsea components.

As shown in FIG. 3A, the driven pile 304 may be substantially flush with the seabed level 308. The enclosure 302 can act to prevent the scouring of the sediment 310 proximate the top of the driven pile 304. In this manner, the integrity of the sediment area 310 in close proximity to the top of the driven pile 304 may be preserved. Therefore, while scouring may continue to erode other areas of the seabed 312, the area immediately adjacent to the driven pile 304 may not be compromised.

The metal plate 306 may provide additional protection from scouring at the top of the driven pile 304. The enclosure 302 reduces or eliminates the effect of scouring forces upon the soil sediment 310 proximate the driven pile 304, such soil sediment 310 stabilizes and provides at least a portion of the load carrying capacity of the driven pile 304 thus ensuring the foundation integrity of the driven pile 304. The maximum axial dimension, $L_e$ 313, or depth of the enclosure 302 may extend beyond the actual and/or predicted scouring line 312. This may prevent the occurrence of ice, wave and current forces reaching the area proximate the top of the driven pile 304, thus protecting the soil sediment 310. As previously discussed, the metal plate 306 may provide a rigid connection between the enclosure 302 and the driven pile 304.

As shown in FIG. 3A, a padeye 314 may be located on an outer side surface of the driven pile 304 at a typical shallow location. A coupling member 316, coupled to the padeye 314, may transfer the load force from an offshore structure being moored to the driven pile 304.

Figure 3B:
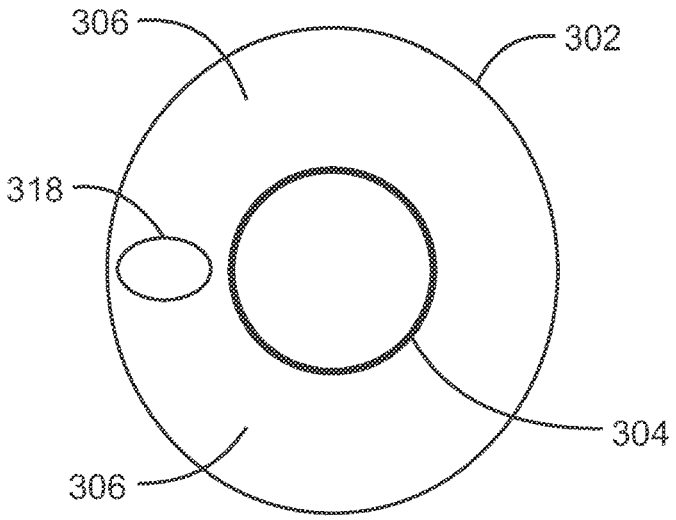
FIG. 3B is an illustration of a top view of an enclosure disposed around a driven pile, the enclosure including a metal plate connecting the enclosure to the driven pile, the metal plate including an opening to accommodate a coupling member in accordance with one or more embodiments of the present disclosure.

FIG. 3B is an illustration of a top view of an enclosure 302 circumferentially disposed around a driven pile 304, the enclosure 302 including a metal plate 306 connecting the enclosure 302 to the driven pile 304. To facilitate a coupling member 316, as shown in FIG. 3A, an opening 318 may be located in the metal plate 306.

Figure 4A:
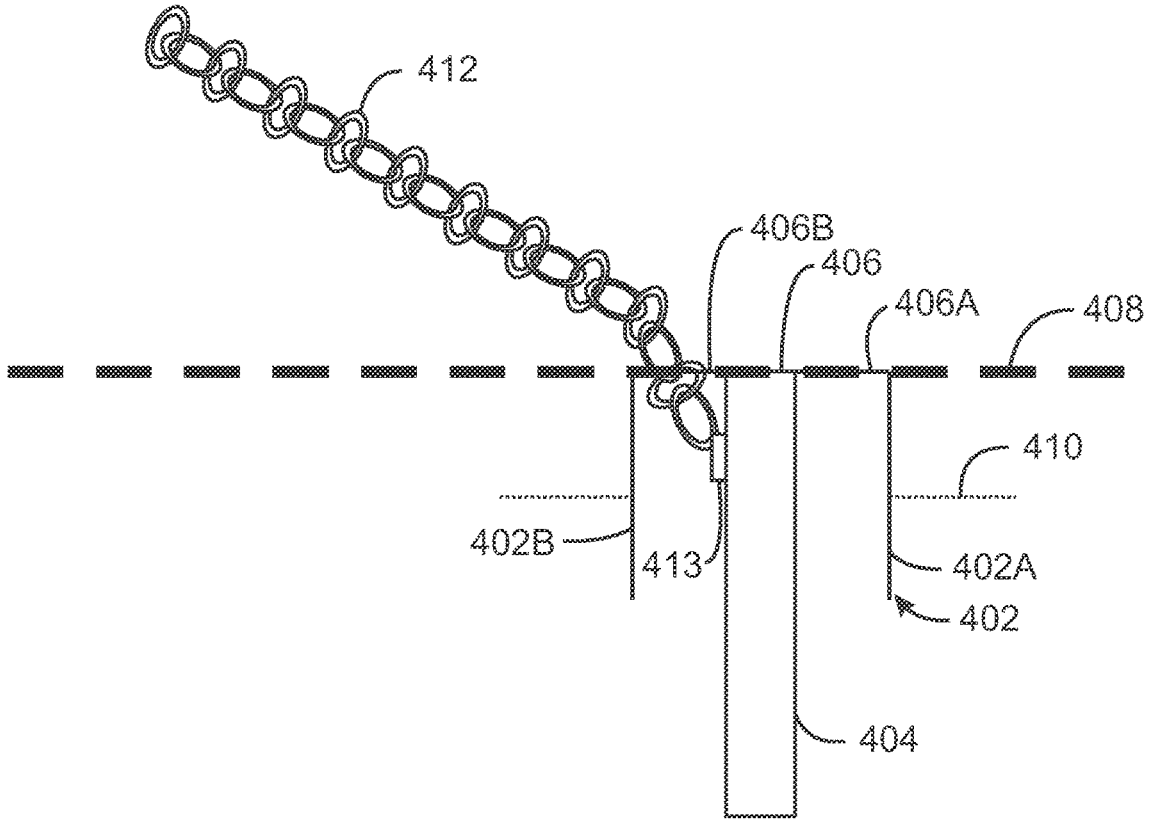
FIG. 4A is an illustration of a side view of an enclosure including multiple sections circumferentially disposed around a pile and including metal plate end sections connecting the multiple circumferential sections of the enclosure in accordance with one or more embodiments of the present disclosure.

FIG. 4A is an illustration of a side view of an enclosure 402 including multiple sections 402A, 402B circumferentially disposed around an existing pile 404 and including metal plate 406 which includes end sections 406A, 406B connecting the multiple circumferential sections 402A, 402B of the enclosure 402 in accordance with one or more embodiments of the present disclosure. As shown in FIG. 4A, the existing pile 404 may penetrate into a seabed 408 so that the existing pile 404 may be substantially flush with the initial seabed 408. As depicted in FIG. 4A, the two enclosure sections 402A, 402B may form axial walls for the enclosure 402. However, any suitable number of sections may be used to form the axial walls of the enclosure 402A, 402B and/or the metal plate 406A, 406B, for example, 3 sections, 4 sections or more. As shown in FIG. 4A, the enclosure 402 may include the sections 402A, 402B, where each section 402A, 402B may be positioned adjacent to one another and may be attached to metal plates 406A, 406B, respectively. The metal plates 406A, 406B may be attached to the respective section 402A, 402B by any suitable mechanism, for example welded together along a seam there between. The metal plates 406A, 406B of the enclosure 402 may be connected using a fastener (not shown), including bolts, clamps, or any other type of fastener that provides a secure connection. In one or more embodiments, a coupling member 412 may be coupled to the padeye 413 located at a shallower depth, e.g., on an outer surface of the existing pile 404 within the axial length of the enclosure 402. The depth of the enclosure 402 may extend beyond the actual and/or predicted scouring line 410.

Figure 4B:
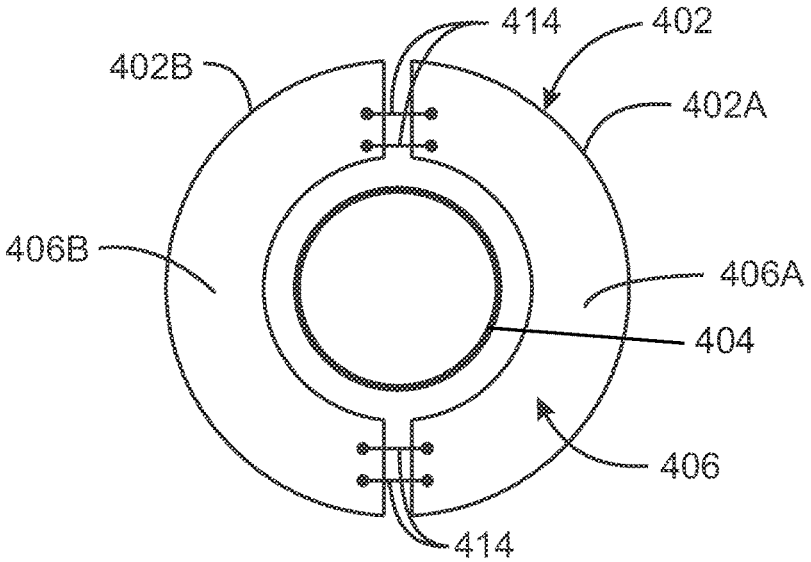
FIG. 4B is an illustration of a top view of the enclosure including multiple sections circumferentially disposed around a pile including a metal plate, where the metal plate includes metal plate end sections connecting the multiple sections of the enclosure in accordance with one or more embodiments of the present disclosure.

FIG. 4B is an illustration of a top view of the enclosure 402 including multiple sections 402A, 402B circumferentially disposed around an existing pile 404 including a metal plate 406, where the metal plate includes metal plate end sections 406A, 406B, connecting the multiple sections 402A, 402B of the enclosure 402 in accordance with one or more embodiments of the present disclosure. In FIG. 4B, the several metal plate sections 406A, 406B may be attached to the multiple sections 402A, 402B by welding so that the enclosure 402 may be disposed around the existing pile 404, for example an existing pile to be rehabilitated. As depicted in FIG. 4B, the metal plate sections 406A, 406B may be fastened together using a fastener 414, including bolts, clamps, welding-methods, or any other type of fastener that provides a secure connection between the multiple sections 406A, 406B. Such connection between metal plate sections 406A, 406B may provide sufficient rigidity to hold the entire enclosure together during installation.

Figure 5:
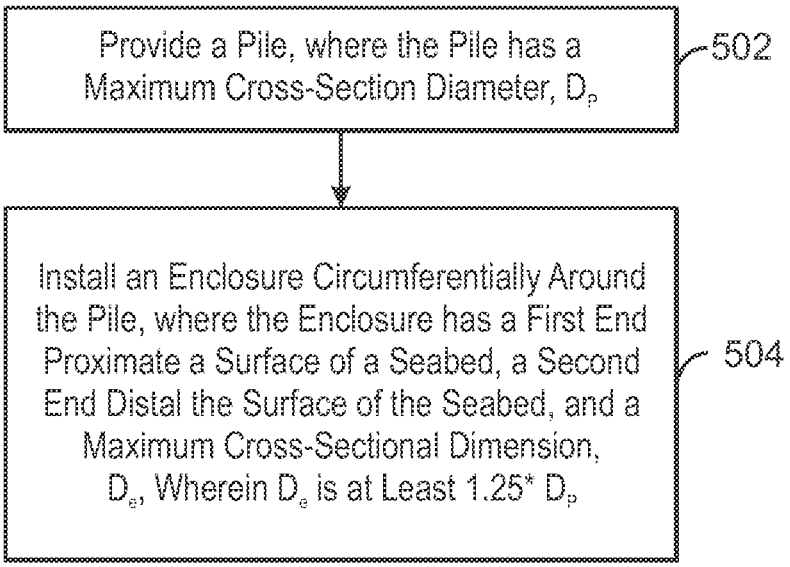
FIG. 5 is a process flow diagram of a method for reducing scouring in accordance with one or more embodiments of the present disclosure.

FIG. 5 is a process flow diagram of a method 500 for reducing scouring. The method 500 begins at block 502 by providing a pile. At block 504, an enclosure may be installed circumferentially around the pile. The pile may have a maximum cross-sectional dimension, $D_p$. After installation of the enclosure, the enclosure may have a first end proximate a surface of a seabed and a second end distal the surface of the seabed. Additionally, the enclosure may have a maximum cross-sectional dimension, $D_e$, wherein $D_e$ is at least $1.25*D_p$. The enclosure may extend below the surface of the seabed. The surface of the seabed may be at an initial level at the point in time when the pile is installed or at a secondary level below the initial seabed level after some amount of scouring has occurred. In one or more embodiments, a prediction of the scouring line may be calculated based on the dimensions of the pile and environmental factors. Additionally, the height of the pile above seabed may also be a factor in the depth of the scoring line as a shorter pile may present less disturbance to the wave and current patterns and thus, less scour than a taller pile of the same diameter. In one or more embodiments, the predicted scouring line may be used to determine the maximum axial dimension, $L_e$, of the enclosure, such that $L_e$ may be greater than the predicted scouring line.

A scouring protection system may be utilized to provide protection to a pile system embedded within an ocean seafloor. A scouring system may implement an enclosure disposed circumferentially around a pile and connected to the pile via a plate installed at the top of the enclosure and the pile. Such a scouring protection system provides the advantage of protecting the seabed between the enclosure and the pile from scouring. In particular, both the pile and sediment area located immediately adjacent to the pile may not succumb to the adverse effects of scouring.

While the present disclosure may be susceptible to various modifications and alternative forms, the one or more embodiments described herein have been shown only by way of example. However, it should again be understood that the present disclosure is not intended to be limited to the particular embodiments disclosed herein. Indeed, the present disclosure includes all alternatives, modifications, and equivalents falling within the true spirit and scope of the appended claims.

What is claimed is:

1. A system for reducing scouring, comprising:

a pile having a maximum cross-sectional dimension, $D_p$, wherein the pile comprises a padeye attached to the outside circumference of the pile; and an enclosure circumferentially disposed around the pile, the enclosure having a first end proximate a surface of a seabed and proximate a top end of the pile; a second end distal the surface of the seabed, and a maximum cross-sectional dimension, $D_e$, wherein $D_e$ is at least $1.25*D_p$ providing a soil sediment area within the seabed between an outer surface of the pile and an inner surface of the enclosure such that the soil sediment area provides load carrying capacity for the pile; wherein the enclosure is fixedly attached to the top end of the pile;

a metal plate attached to the first end of the enclosure wherein the metal plate comprises an opening in the metal plate; and a coupling member that is coupled to the padeye and designed to transfer a load force from an offshore structure that is moored to the pile; wherein the coupling member passes from the padeye, through the soil sediment area located between the outer surface of the pile and the inner surface of the enclosure, through the opening in the metal plate attached to the first end of the enclosure, and to the offshore structure.

2. The system of claim 1, wherein $D_e$ is at least $2*D_p$.

3. The system of claim 1, wherein the enclosure has a maximum axial dimension, $L_e$, greater than a predicted scouring line.

4. The system of claim 1, wherein the enclosure has a maximum axial dimension, $L_e$, and at least 90% of the maximum axial dimension, $L_e$, is disposed beneath a surface of the seabed.

5. The system of claim 1, wherein the metal plate is configured to connect the enclosure to the pile.

6. The system of claim 1, wherein the enclosure is configured to be connected to the pile prior to installation in the seabed.

7. The system of claim 1, wherein the enclosure is configured to be connected to an existing pile to mitigate scouring around the pile.

8. The system of claim 1, wherein the enclosure comprises multiple axial sections configured to be connected together to be disposed circumferentially around the pile.

9. The system of claim 1, wherein the pile is a suction pile.

10. The system of claim 1, further comprising at least one internal structure disposed radially between an outer surface of the pile and an inner surface of the enclosure.

11. A method for reducing scouring around a pile, comprising:

providing a pile, wherein the pile has a maximum cross-sectional dimension, $D_p$, and the pile comprises a padeye attached to the outside circumference of the pile; and installing an enclosure circumferentially around the pile, wherein the installed enclosure has a first end proximate a surface of a seabed and proximate a top end of the pile, a second end distal the surface of the seabed, and a maximum cross-sectional dimension, $D_e$, wherein $D_e$ is at least $1.25*D_p$ providing a soil sediment area within the seabed between an outer surface of the pile and an inner surface of the enclosure such that the soil sediment area provides load carrying capacity for the pile; wherein the enclosure is fixedly attached to the top end of the pile;

attaching a metal plate to the first end of the enclosure wherein the metal plate comprises an opening in the metal plate; and installing a coupling member that is coupled to the padeye and transfers a load force from an offshore structure that is moored to the pile; wherein the coupling member passes from the padeye, through the soil sediment area located between the outer surface of the pile and the inner surface of the enclosure, through the opening in the metal plate of the first end of the enclosure, and to the offshore structure.

12. The method of claim 11, wherein the metal plate is configured to connect the enclosure to the pile.

13. The method of claim 11, wherein the enclosure is connected to the pile prior to installation of the pile in the seabed.

14. The method of claim 11, wherein the pile is an existing pile and the enclosure is installed around the existing pile to mitigate scouring around the pile.

15. The method of claim 11, wherein the pile is installed by driving the pile into the seabed.

16. The method of claim 11, comprising providing at least one internal structure disposed radially between an outer surface of the pile and an inner surface of the enclosure.

17. The method of claim 11, wherein De is at least $2*D_p$.

18. The method of claim 11, further comprising predicting a scouring line.

19. A system for reducing scouring around anchors used for offshore production facilities, comprising:

a plurality of piles for stabilizing an offshore floating structure, wherein each pile has a maximum cross-sectional dimension, $D_p$, and each pile comprises a padeye attached to the outside circumference of the pile; and an enclosure circumferentially disposed around each pile, the enclosure having a first end proximate a surface of a seabed and proximate a top end of the pile; a second end distal the surface of the seabed, and a maximum cross-sectional dimension, $D_e$, wherein De is at least $1.25*D_p$ providing a soil sediment area within the seabed between an outer surface of the pile and an inner surface of the enclosure such that the soil sediment area provides load carrying capacity for the pile; wherein the enclosure is fixedly attached to the top end of the pile;

a metal plate attached to the first end of the enclosure wherein the metal plate comprises an opening in the metal plate; and a coupling member that is coupled to the padeye and designed to transfer a load force from an offshore structure that is moored to the pile; wherein the coupling member passes from the padeye, through the soil sediment area located between the outer surface of the pile and the inner surface of the enclosure, through the opening in the metal plate of the first end of the enclosure, and to the offshore structure.

20. The system of claim 19, wherein each metal plate connects the enclosure to each of the plurality of piles.

* * * * *